US006292642B1

(12) United States Patent
Chang et al.

(10) Patent No.: US 6,292,642 B1
(45) Date of Patent: Sep. 18, 2001

(54) SQUEEGEE ROLLER LIQUID ELECTROPHOTOGRAPHIC PRINTER

(75) Inventors: Kee-son Chang; Jin-geun Kwak, both of Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/615,760

(22) Filed: Jul. 13, 2000

(30) Foreign Application Priority Data

Aug. 20, 1999 (KR) ..... 99-34576

(51) Int. Cl.[7] ..... G03G 15/10
(52) U.S. Cl. ..... 399/249
(58) Field of Search ..... 399/249, 248, 399/239, 348; 492/18, 30, 31; 118/70, 104, 109

(56) References Cited

U.S. PATENT DOCUMENTS 4,091,404 * 5/1978 Schornig et al. ..... 396/614
4,127,082 * 11/1978 Kawabata ..... 399/239
5,576,815 * 11/1996 Teschendorf et al. ..... 399/249
6,104,901 * 8/2000 Imamiya ..... 399/249
6,144,827 * 11/2000 Iikura ..... 399/249

FOREIGN PATENT DOCUMENTS 61-272771 * 12/1986 (JP) .

* cited by examiner

*Primary Examiner*—Robert Beatty
(74) *Attorney, Agent, or Firm*—Sughrue, Mion, Zinn, Macpeak & Seas, PLLC

(57) ABSTRACT

A squeegee roller for a liquid electrophotographic printer includes a steel core and an elastic rubber layer coated on an outer circumferential surface of the steel core. The elastic rubber layer forms a squeegee nip by contacting a photoreceptor web, thereby to make a toner of the excess developer, which is developed in an area for an electrostatic latent image of the photoreceptor web, into a thin film in the area for electrostatic latent image and to squeeze the remaining carrier. The roughness (Ra) of a surface of the elastic rubber layer satisfies the condition, $1.5\ \mu m \leqq Ra \leqq 2.5\ \mu m$. Further ,a criss-cross grove pattern is formed on the surface of the squeegee roller so as to guide the excess developer liquid

2 Claims, 4 Drawing Sheets

50

SQUEEGEE ROLLER LIQUID ELECTROPHOTOGRAPHIC PRINTER

BACKGROUND OF THE INVENTION

1. Field of the Invention

The present invention relates to a squeegee roller for a liquid electrophotographic printer and, more particularly, to a squeegee roller for a liquid electrophotographic printer in which the roughness of a surface of an elastic rubber layer thereof is improved so that the efficiency of squeegeeing is improved.

2. Description of the Related Art

In general, a liquid electrophotographic printer, such as a color laser printer or a copier, produces a desired image by electrically attaching developer, which is a mixture of a solid toner having a predetermined color and a liquid carrier functioning as a solvent, to an area for an electrostatic latent image formed on a surface of a photoreceptor medium such as a photoreceptor web. A development unit for developing the developer in the area for an electrostatic latent image of the photoreceptor medium is provided in the printer.

Referring to FIG. 1, a development unit of the conventional liquid electrophotographic printer includes a development tray 12 for finally collecting developer D after being used for development, a development roller 14 arranged to maintain a predetermined distance of development gap G with respect to a photoreceptor web 10, a manifold 116 through which developer D is injected to the development gap G, a development container 13 for containing the collected developer D which is injected to the development roller 14, a development roller cleaning apparatus for removing the developer adhering to the outer circumferential surface of the development roller 14, and a squeegee roller 15 for making toner of the developer remaining on the photoreceptor web 10 a film and for separating carrier from the photoreceptor web 10.

The development roller cleaning apparatus rotates in contact with the development roller 14 and includes a brush roller 18, part of which is submerged in the developer D, and a blade 14*b* for removing foreign materials adhering to the surface of the development roller 14 which remain between the brush roller 18 and the development roller 14 after cleaning. Reference numeral 17 denotes a squeegee blade for squeegeeing developer while contacting a surface of the squeegee roller 15 in a drip-line removing mode after development.

FIG. 2 is a view for explaining the operation of the squeegee roller 15 which removes carrier. As shown in the drawing, after development, developer still remains between the photoreceptor web 10 and the squeegee roller 15. The remaining developer is referred to as a drip-line (DL). To remove the drip-line (DL), the blade 17 is allowed to contact the squeegee roller 15 and the circulating speed of the photoreceptor web 10 is reduced. In this state, a pressing force applied to the squeegee roller 15 contacting the photoreceptor web 10 is slightly reduced and the squeegee roller 15 is rotated in a direction reverse to the direction in which the photoreceptor web 10 circulates. Then, the drip line (DL) is removed and flows down along an outer circumferential surface of the squeegee roller 15. The developer is squeegeed by the blade 17 and falls into the developer tray 12.

However, the squeegee roller 15 is made by coating an elastic material around a metal core. There is no optimized specifications for the roughness of a surface thereof and the shape of a surface pattern. Thus, when the roughness of the surface of the squeegee roller 15 is less than or equal to 1.0 $\mu$m, the surface of the squeegee roller 15 becomes too slippery. Then, as shown in FIG. 3, developer at A, B and C remaining on the photoreceptor web 10 flows in a direction reverse to a direction in which the photoreceptor web 10 proceeds, by the pressing force of the squeegee roller 15. Consequently, the printed image is deteriorated.

Meanwhile, when the roughness of the surface of the squeegee roller 15 is greater than or equal to 3.0 $\mu$m, the surface of the squeegee roller 15 becomes too rough. Thus, the developer on the surface of the photoreceptor web 10 is not squeegeed by the squeegee roller 15 and continuously remains on the photoreceptor web 10. Therefore, the efficiency of squeegeeing is lowered.

SUMMARY OF THE INVENTION

To solve the above problems, it is an objective of the present invention to provide a squeegee roller for a liquid electrophotographic printer in which the roughness of the surface thereof is maintained between 1.5–2.5 $\mu$m and a pattern with grooves is formed about 45° on the surface thereof, to improve the efficiency of squeegeeing.

Accordingly, to achieve the above objective, there is provided a squeegee roller for a liquid electrophotographic printer which comprises a steel core and an elastic rubber layer coated on an outer circumferential surface of the steel core and forming a squeegee nip by contacting a photoreceptor web, thereby to make a toner of the excess developer, which is developed in an area for an electrostatic latent image of the photoreceptor web, into a thin film in the area for electrostatic latent image and to squeeze the remaining carrier, in which the roughness (Ra) of a surface of the elastic rubber layer satisfies the condition, $1.5\ \mu m \leqq Ra \leqq 2.5\ \mu m$.

In this case, it is preferred in the present invention that a groove pattern having an inclination of about 45° with respect to an axial direction of the squeegee roller is formed on a surface of the elastic rubber layer to guide exhaust of excess developer squeegeed from the squeegee nip to the surface of the elastic rubber layer.

BRIEF DESCRIPTION OF THE DRAWINGS

The above objective and advantages of the present invention will become more apparent by describing in detail a preferred embodiment thereof with reference to the attached drawings, in which.

DETAILED DESCRIPTION OF THE INVENTION

Figure 4:
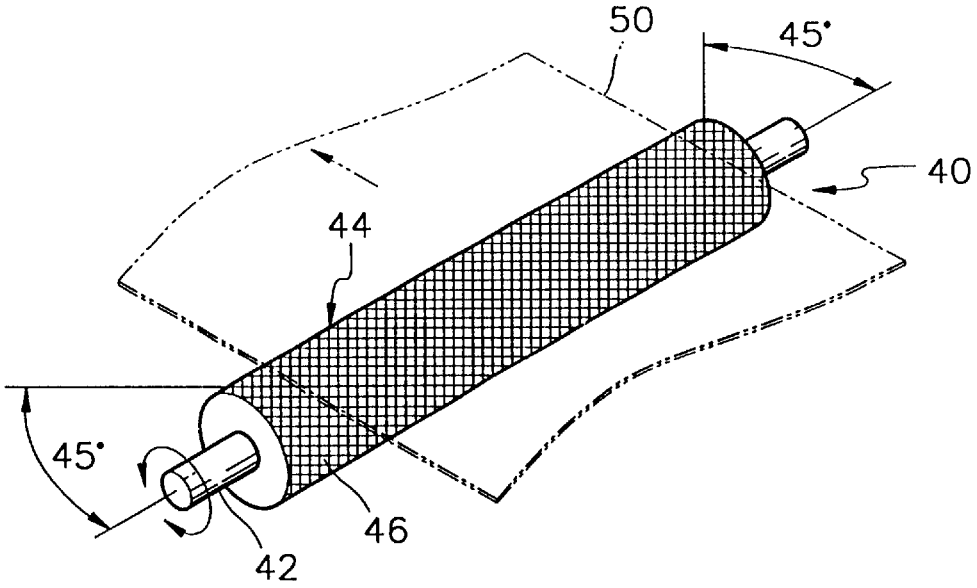
FIG. 4 is a perspective view showing a squeegee roller for a liquid electrophotographic printer according to a preferred embodiment of the present invention.

Referring to FIG. 4, in a squeegee roller for a liquid electrophotographic printer according to a preferred embodiment of the present invention, an elastic rubber layer 44 having a predetermined thickness is formed on the outer circumferential surface of a steel core 42. The elastic rubber layer 44 is formed by kneading rubber liquid and press-injecting the same onto the steel core 42, or molding the rubber liquid on the steel core 42 in a predetermined shape. The elastic rubber layer 44 makes the toner of the developer, which is developed in an area for an electrostatic latent image of a photoreceptor web 50, into a thin film, and forms a squeegee nip, which refers to an area where the rubber layer 44 contacts the photoreceptor web 50, while contacting the s15 photoreceptor web 50 to squeegee the remaining carrier.

To facilitate exhaust of the excess developer squeegeed from the squeegee nip to a surface of the elastic rubber layer 44, a groove pattern 46 is formed about 45° with respect to an axial direction of the squeegee roller 40 on the surface of 20 the elastic rubber layer 44. If the groove pattern 46 is parallel to the circumferential direction of the squeegee roller 40, as more developer passes the squeegee nip at the portion of the groove of the squeegee roller 40, the efficiency of squeegeeing is lowered. If the groove pattern 46 is parallel to the axial direction of the squeegee roller 40, the efficiency of squeegeeing is improved. However, as developer remains on the surface of the squeegee roller 40, there is a problem in that the developer does not drain well. Therefore, the angle of groove pattern 46 becomes optimal when a predetermined roughness of the surface of the squeegee roller 40 is formed and also the developer existing on the photoreceptor web 50 is squeegeed by the squeegee roller 40 and easily guided along the squeegee roller 40.

Figure 5:
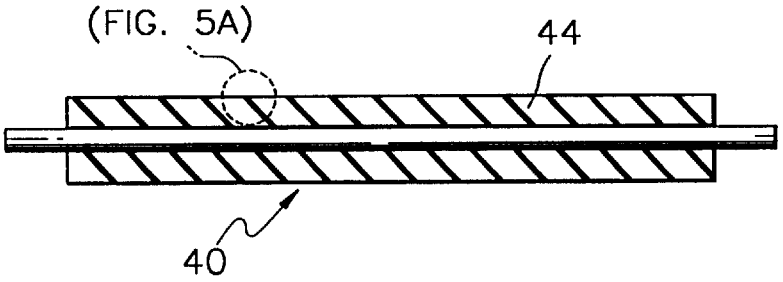
FIG. 5 and FIG. 5A are a sectional view and a magnified sectional view, respectively, of the squeegee roller shown in FIG. 4.
Figure 5A:
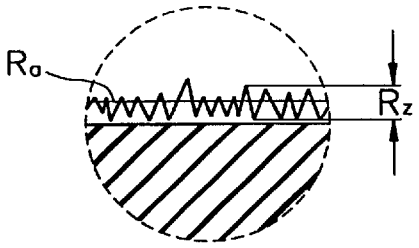

FIG. 5 and FIG. 5A are a sectional view and a magnified sectional view, respectively, of the surface of the squeegee roller 40. In the drawing, the roughness of the surface of the elastic rubber layer 44 is processed to be within a range between 1.5–2.5 μm and preferably about 2.0 μm. The roughness of surface Ra is the average area of a sine wave of the groove pattern 46. Also, the roughness of surface Ra is obtained by multiplying by 8 the distance Rz between the third peak and the third pit in the order of a descending power from the highest peak or in the order of an ascending power from the lowest pit among the high peaks and low pits arbitrarily extracted from the sine wave curve, that is, from the equation of Rz=8Ra.

Figure 6:
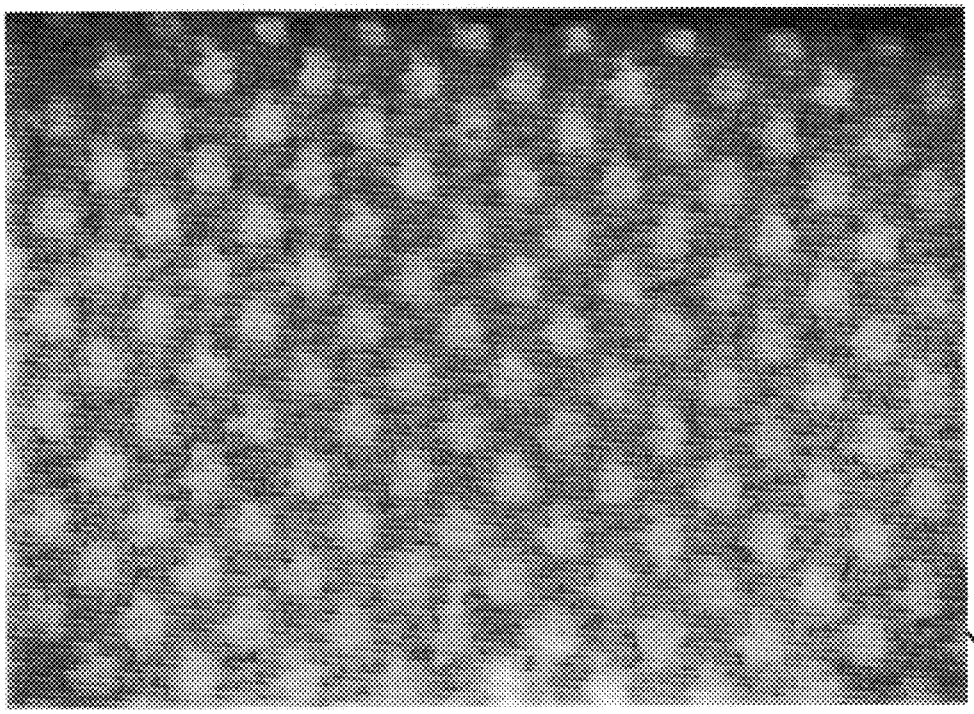
FIG. 6 is a photograph showing a 100×magnified view of the surface of the photoreceptor web squeegeed by the squeegee roller shown in FIG. 4.

FIG. 6 shows the surface of the photoreceptor web squeegeed by the squeegee roller 40 according to the preferred embodiment of the present invention, magnified 100 times.

Figure 1:
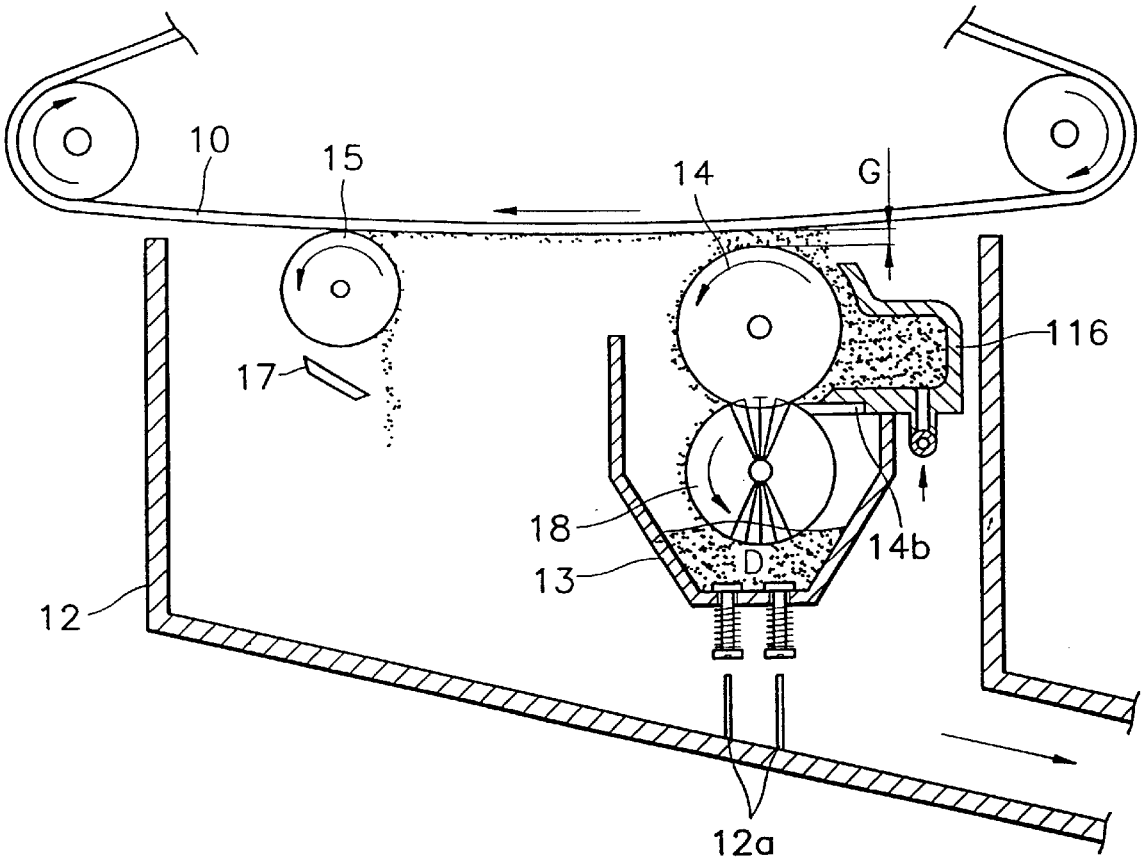
FIG.1 (PRIOR ART)
FIG. 1 is a view showing the structure of a development unit of a conventional liquid electrophotographic printer.
Figure 2:
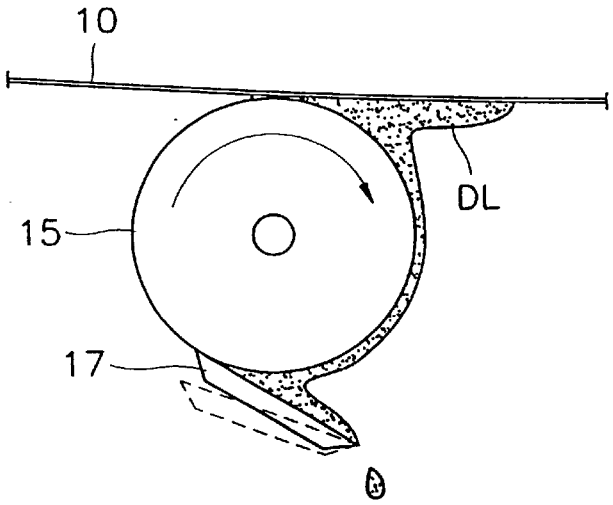
FIG.2 (PRIOR ART)
FIG. 2 is a view showing the squeegee roller shown in FIG. 1.
Figure 3:
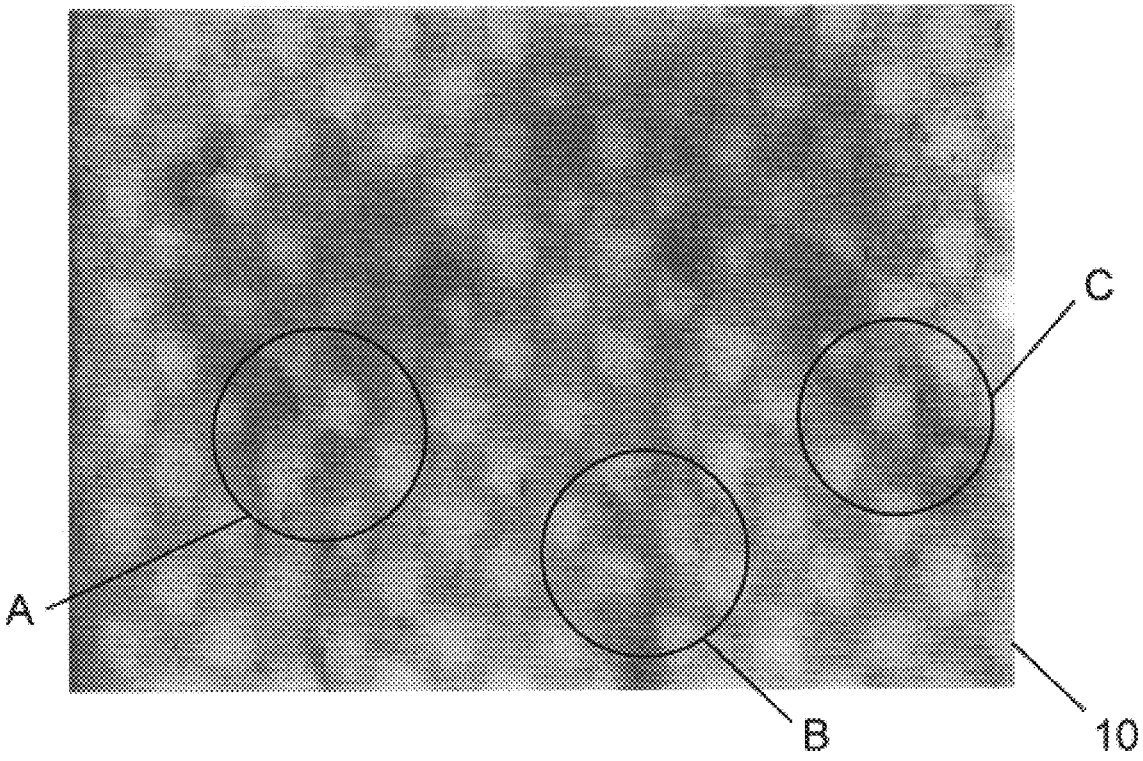
FIG. 3 is a photograph showing a 100×magnified view of the surface of the photoreceptor web squeegeed by the conventional squeegee roller.

In the description of FIG. 6 compared to FIG. 3, as the developer flows in a direction opposite to the direction in which the photoreceptor web 10 proceeds on the surface of the photoreceptor web 10 squeegeed by the conventional squeegee shown in FIG. 3, deterioration of an image occurs. However, as shown in FIG. 6, developer is completely squeegeed and barely remains on the surface of the photoreceptor web 50 which is squeegeed by the squeegee roller (40 of FIG. 4) according to the preferred embodiment of the present invention. Therefore, deterioration of an image barely occurs and an accurate and clear image is reproduced.

As described above, the squeegee roller for a liquid electrophotographic printer according to the present invention has the following advantages.

First, by processing the roughness of the surface of the squeegee roller to be maintained within a range of about 2.0±0.5 μm, the efficiency of squeegeeing can be improved.

Second, by forming a groove pattern having about 45° with respect to the axial direction of the squeegee roller on the surface of the squeegee roller, the efficiency of squeegeeing can be maximized.

It is contemplated that numerous modifications may be made to the squeegee roller of the present invention without departing from the spirit and scope of the invention as defined in the following claims.

What is claimed is:

1. A squeegee roller for a liquid electrophotographic printer, comprising:

a steel core; and an elastic rubber layer coated on an outer circumferential surface of the steel core and forming a squeegee nip by contacting a photoreceptor web, thereby to make a toner of excess developer, which is developed in an area for an electrostatic latent image of the photoreceptor web, into a thin film in the area for electrostatic latent image and to squeeze a remaining carrier, wherein a roughness (Ra) of a surface of said elastic rubber layer satisfies the following condition $$1.5\ \mu m \leq Ra \leq 2.5\ \mu m$$

wherein a criss-cross groove pattern having an inclination of about 45° with respect to an axial direction of the squeegee roller is formed on the surface of said elastic rubber layer to guide exhaust of excess developer squeegeed from the squeegee nip to the surface of said elastic rubber layer.

2. The squeegee roller as claimed in claim 1, wherein the roughness (Ra) of the surface of said elastic rubber layer is 2.0 μm.

* * * * *